US006068877A

United States Patent [19]

Seitz et al.

[11] Patent Number: 6,068,877

[45] Date of Patent: May 30, 2000

[54] METHOD OF DETECTING WORKPIECES IN AN ELECTROSTATIC COATING SYSTEM

[75] Inventors: Kurt Seitz, Widnau; Markus Hasler, Montlingen; Horst Adams, Gallen, all of Switzerland

[73] Assignee: Wagner International AG, Alstatten, Switzerland

[21] Appl. No.: 09/144,748

[22] Filed: Sep. 1, 1998

[30] Foreign Application Priority Data

Sep. 1, 1997 [DE] Germany ..... 197 38 142

[51] Int. Cl.[7] ..... B05D 1/04

[52] U.S. Cl. ..... 427/8; 427/477; 427/479; 427/480

[58] Field of Search ..... 427/8, 475, 477, 427/479, 480, 483; 118/668, 671, 679, 669, 675–677

[56] References Cited

U.S. PATENT DOCUMENTS

| | | | |
|---|---|---|---|
| 2,966,880 | 1/1961 | Gengenbach et al. . | |
| 3,851,618 | 12/1974 | Bentley . | |
| 4,324,812 | 4/1982 | Bentley | 427/8 |
| 4,357,900 | 11/1982 | Buschor | 118/681 |
| 5,506,746 | 4/1996 | Seitz | 361/228 |
| 5,864,239 | 1/1999 | Adams et al. | 324/636 |

FOREIGN PATENT DOCUMENTS

| | | |
|---|---|---|
| 899018 | 3/1999 | European Pat. Off. . |
| 38 22 835 A1 | 3/1990 | Germany . |
| 195 02 390 A1 | 1/1996 | Germany . |
| 44 06 046 C2 | 11/1997 | Germany . |

OTHER PUBLICATIONS

JOT, No. 8, 37 Jahrgang–D13194, Aug. 1997.

"Taschenbuch für Lackierbetriebe 1997", Curt R. Vincentz Verlag, Hannover 1996.

"Neue Steuerungssystee für flexible Lackiertechnik", Von Werner Heine, Kopperschmidt–Mueller GmbH & Co. KG, Winnenden, I–Lack , 53 Jahrgang Jan. 1985, pp. 13–17.

*Primary Examiner*—Fred J. Parker

*Attorney, Agent, or Firm*—Faegre & Benson LLP

[57] ABSTRACT

The invention refers to a method of detecting workpieces in an electrostatic coating system, comprising at least one electrostatic coating device, which applies a high voltage to a high voltage electrode, in which the high voltage electrode generates a spray current including electrostatic charges for charging particles of a coating medium to be sprayed, an electrically conductive workpiece to be coated is moved past the coating device, the spray current of the high voltage electrode is determined and it is detected in accordance with the magnitude of the spray current whether the workpiece is in front of the coating device.

17 Claims, 9 Drawing Sheets

CASE A: MOVEMENT OF THE LIFT DEVICE "SYNCHRONIZED"

CASE B: MOVEMENT OF THE LIFT DEVICE NOT "SYNCHRONIZED"

METHOD OF DETECTING WORKPIECES IN AN ELECTROSTATIC COATING SYSTEM

BACKGROUND OF THE INVENTION

The present invention refers to a method of detecting workpieces in an electrostatic coating system, as well as an electrostatic coating system in which this method can be used.

Conventional automatic coating systems are controlled by storage program controls (SPC). For this purpose a central computer unit is provided from which a plurality of electric and pneumatic lines extend to sensors and actuators of the system.

The current states of the sensors (e.g. supply clock of the workpiece, level of the reservoir etc.) are cyclically detected by the central unit, the necessary reactions of the associated actuators are calculated and appropriate control commands are supplied to the actuators.

In the conventional electrostatic powder coating system, a workpiece passes in the horizontal direction through a coating compartment with vertical slots being provided in the side walls of the coating compartment. Through these slots electrostatic coating guns discharge coating powder into the coating compartment. While the workpiece is passed through the coating compartment, the successively arranged plurality of coating guns reciprocate in the vertical direction, wherein the workpiece is coated by a plurality of adjoining or partially overlapping sine-shaped powder clouds due to the workpiece movement in the horizontal and the coating gun movement in the vertical direction.

In order to achieve a regular and sufficient coating thickness on the workpiece and in order to optimize the efficiency during powder application, the vertical stroke of movement of the coating devices and the powder discharge are controlled. Additionally, the spacing between the coating device and the workpiece is adjusted in the spray direction in order to prevent the powder from being blown off again in case the spacing is too low or to avoid the creation of electrostatic craters, or in the reverse case that the efficiency of the powder coating is aggravated and e.g. the penetration ability into the cavities decreases.

For this purpose, known powder coating system have a workpiece detection and identification means as well as a timer means.

The workpiece detection is used for instance in coating apparatus for realizing a gap control. For this purpose the supply and therefore the application of powder lacquer or wet lacquer is interrupted in workpiece gaps. Thereby the consumption of coating materials, the amount of waste of wet lacquers and the recirculated portion of powder lacquers is reduced. The basic design of a gap control of the prior art is shown in FIG. 9.

A workpiece feed device 902 transports workpieces 904 through a coating compartment 901 in the direction indicated. To realize the gap control a device for detecting a workpiece 904 is required. This device consists of a light barrier 906 or 906', 908, wherein light is transmitted by the light emitter 906 or 906' and received by the receiver 908, and wherein respective signals are passed on to a control 912.

The light barrier is preferably located outside the coating compartment 901. For the time-variant control of the material supply, the control 912 requires an additional signal which is proportional to the speed of the feed device 902. This signal directly comes from a feed system control 915 or it is determined by a special means 913 for measuring the feed speed. This speed measuring device generates a signal proportional to the feed speed and passes it on to the control 912. From the speed information and the signal of the light barrier 806, 908 the control 912 determines the time required by the workpiece 904 to reach the spray device 905.

The light barrier 906, 908 also "informs" the control 912 about the end of a workpiece. This is a device which detects the entry of a workpiece 904 into the compartment 901, which detects the length of the workpiece and which is capable of turning on and off the material supply 910, 911 in a time-delayed manner in accordance with the speed of the feed device 902.

To control the powder devices, the prior art further provides a position control means and a motion control means, which also require the information about the start, the end and the speed of the workpiece. The position control controls the distance of the coating devices to the workpieces. The motion control means controls the vertical movement of the coating devices.

The coating system requires a great calculation effort in order to switch the plurality of coating system on and off in a synchronized manner, and to reciprocate them up and down and back and forth so that an optimum coating result is achieved.

Furthermore, a relatively complex and expensive detection device is required for the workpiece detection and identification.

The object of the invention is to provide a method of detecting a workpiece in an electrostatic coating system, and a new coating system in which the amount of hardware and software for the workpiece detection and identification can be reduced and the control can be simplified.

This object is achieved by a method having the features described in the claims.

BRIEF SUMMARY OF THE INVENTION

According to the present invention a method of detecting workpieces in an electrostatic coating system is provided, the electrostatic coating system comprising at least one electrostatic coating device which applies a high voltage to a high voltage electrode, in which a spray current containing electrical charges for charging particles of a coating material to be sprayed is generated by the high voltage electrode, an electrically conductive workpiece to be coated is passed by a coating device, the spray current of the high voltage electrode is determined, and depending on the magnitude of the determined spray current it is detected whether the workpiece is in front of the coating device.

According to a further aspect of the invention, an electrostatic coating system comprising at least one coating device is provided, including a high voltage electrode which discharges electrical charges including a spray current for charging particles of a coating material to be sprayed, wherein the or each coating device has assigned thereto a measuring device for measuring the spray current, and an evaluating device, which detects in accordance with the measured spray current, whether a workpiece is in front of the coating device.

The invention utilizes the fact that in an electrostatic coating device, a high voltage electrode or spray electrode discharges electrical charges into the environment, which generate an electric spray current from the high voltage electrode through the air to ground, independent of the fact whether at the same time a coating material is discharged to the workpiece by the coating device or not. If an electrically conductive, grounded workpiece is moved past the coating device, the electric spray current flows from the high voltage electrode through the workpiece to ground.

Upon approach of the workpiece to the spray gun, the spray current rises continuously (see FIG. 2). If the spray electrode is on the same level as the workpiece, the spray current continues to change, however, insignificantly only. The increase of the spray current is utilized for workpiece detection. Measurements proved that the total current that flows through the electrode is determined mainly by the spacing between the spray electrode and the workpiece and by the high voltage set.

The measurement of the spray current can therefore be used as a means for detecting a workpiece in front of the coating device. According to the invention, the operation of the coating devices is controlled in accordance with the level of the spray current.

The optical workpiece detection common in the prior art can therefore be omitted.

By defining suitable threshold values, it can be detected whether the workpiece approaches the coating device, whether it is directly in front of it or whether it departs from it and whether it has the correct distance to the spray electrode.

The new method of workpiece detection according to the invention enables to realize for instance a gap control in a much more simple manner than in the prior art by detecting a workpiece on the spot, i.e. at the coating gun, and by activating the supply and discharge of the coating material in accordance with the existence of a workpiece. Thus, an external "gap control" is not required in the new system.

As mentioned above, the decisive factor for the size of the spray current is, besides the selection of the high voltage, most of all the spacing between workpiece and electrode.

For an optimum coating result, this spacing should be constant. Since, however many workpieces exist having contours changing in the longitudinal direction and the spray gun makes a vertical movement, the distance changes. Depending on the spray current measured, the spacing between the workpiece and the coating device in the spray direction can be detected and kept constant.

The workpiece detection can also be used for detecting the speed of a workpiece. Since in practice often at least three or more guns are successively arranged in the horizontal direction at equal spacings, the feed speed can be derived therefrom. Since a speed selected once remains constant over an extended period of time, the feed speed can be calculated more precisely from a plurality of successive relatively inaccurate measurements by means of statistic methods.

The speed information can then be used for controlling and synchronizing the vertical movements of the coating devices.

The method of detecting workpieces by the aid of the spray currents of the electrostatic devices according to the invention provides a reliable, fast and useful means for detecting and identifying the workpieces to be coated which may completely replace the workpiece detection and identification means of the prior art. Furthermore, the invention has the advantage that the presence of a workpiece can be permanently monitored during operation in front of the respective coating devices, and that it is not, as in the prior art, detected as a result of a single measurement when the workpiece enters the coating compartment. In case of an unscheduled standstill of the workpiece supply, the powder discharge can for instance be stopped immediately. Furthermore, the invention enables a substantial decentralization of the coating system, since every coating device detects independently whether a workpiece is present and is capable of controlling its spacing to the workpiece and its power supply in accordance with the spray current.

BRIEF DESCRIPTION OF THE DRAWINGS

The invention will now be described by means of an example of an electrostatic powder coating system with reference to the drawings.

DETAILED DESCRIPTION OF THE INVENTION

Figure 1:
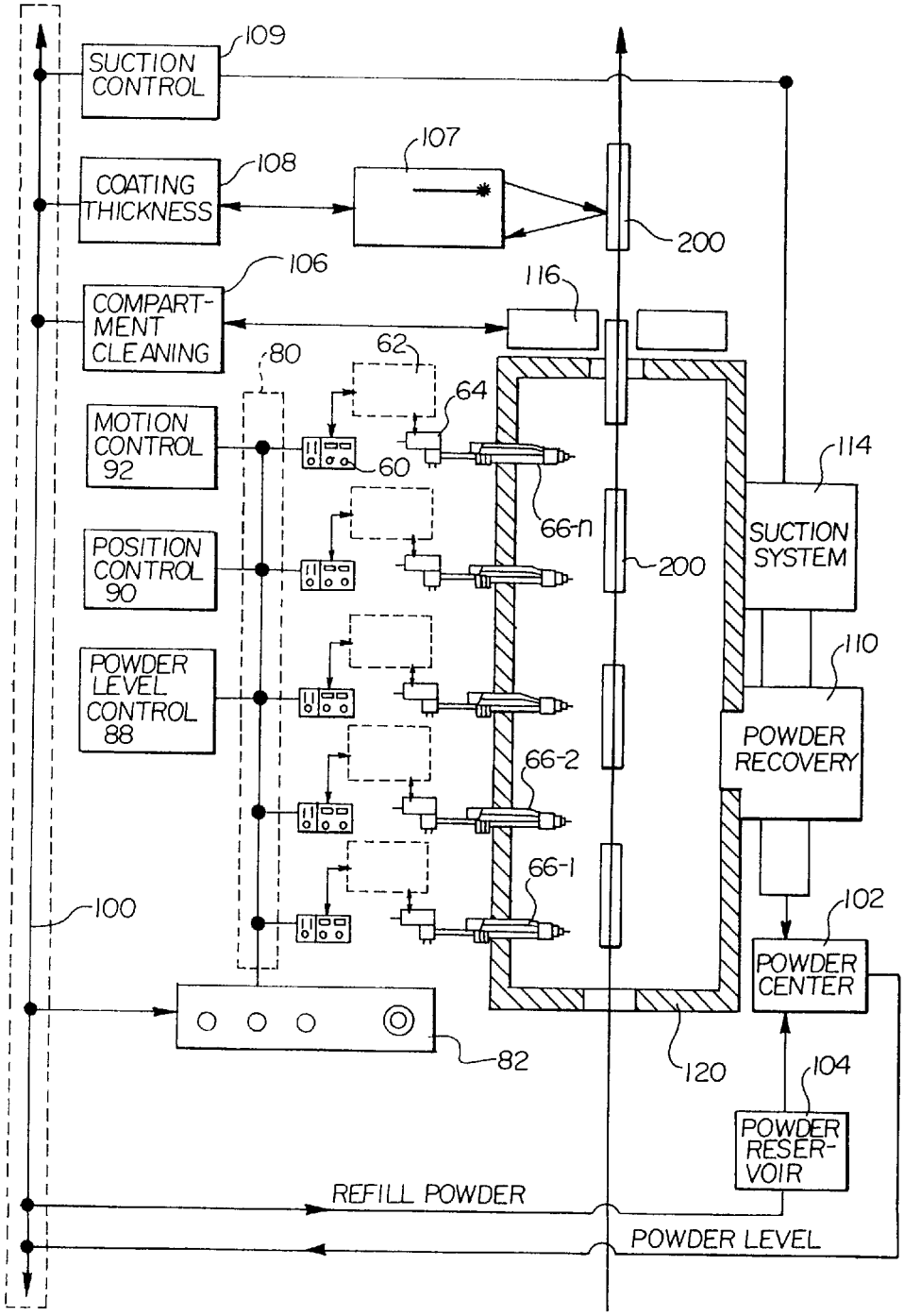
FIG. 1 shows an electrostatic powder coating system according to the present invention.

FIG. 1 shows a powder coating system according to the invention. This powder coating system is described in more detail in the German patent application DE-A 197 38 141 "Control system of a coating system" belonging to the same applicant having the same filing day.

In FIG. 1, a plurality of (five) coating modules are shown, each consisting of a digital control device 60, an injector 64 and a spray gun 66 which are connected to one another via a gun bus. Necessary operation information regarding the operating conditions of the coating system are received by the control devices 60 via an internal bus 80.

The plurality of coating modules are further connected to one another and to a central control unit 82 as well as to further components of the system via the internal bus 80. Additional modules connectable to the internal bus are e.g. a powder level control module 88, a position control module 90 and a motion control module 92.

Further components are also provided which are also connected to the central control unit 82 via an external bus 100. These components comprise a powder center 102, a powder reservoir 104, a layer thickness measuring and control means 107, 108, and an air quantity control means 109 for a powder recovery system 110, 114 and the like.

The buses 62, 80, 100 are preferably LON buses (LON= local area network). The individual components, configured as LON nodes, are able to register in the system themselves, detect other system components, adjust thereto and communicate therewith. They may evaluate and utilize information about the respective operating conditions of the coating system which they receive from the bus 80 or 100.

The operation of the powder coating system shown in FIG. 1 is as follows. A workpiece 200 approaches a coating compartment 120. A high voltage of approximately 100 kV is applied at the high voltage electrodes of the spray guns 66-1, 66-2, . . . 66-n, so that an electric spray current flows from the respective electrodes through the air to the ground. This spray current is, as long as no grounded workpiece is in front of the respective spray gun, very small (so-called zero current).

Figure 2:
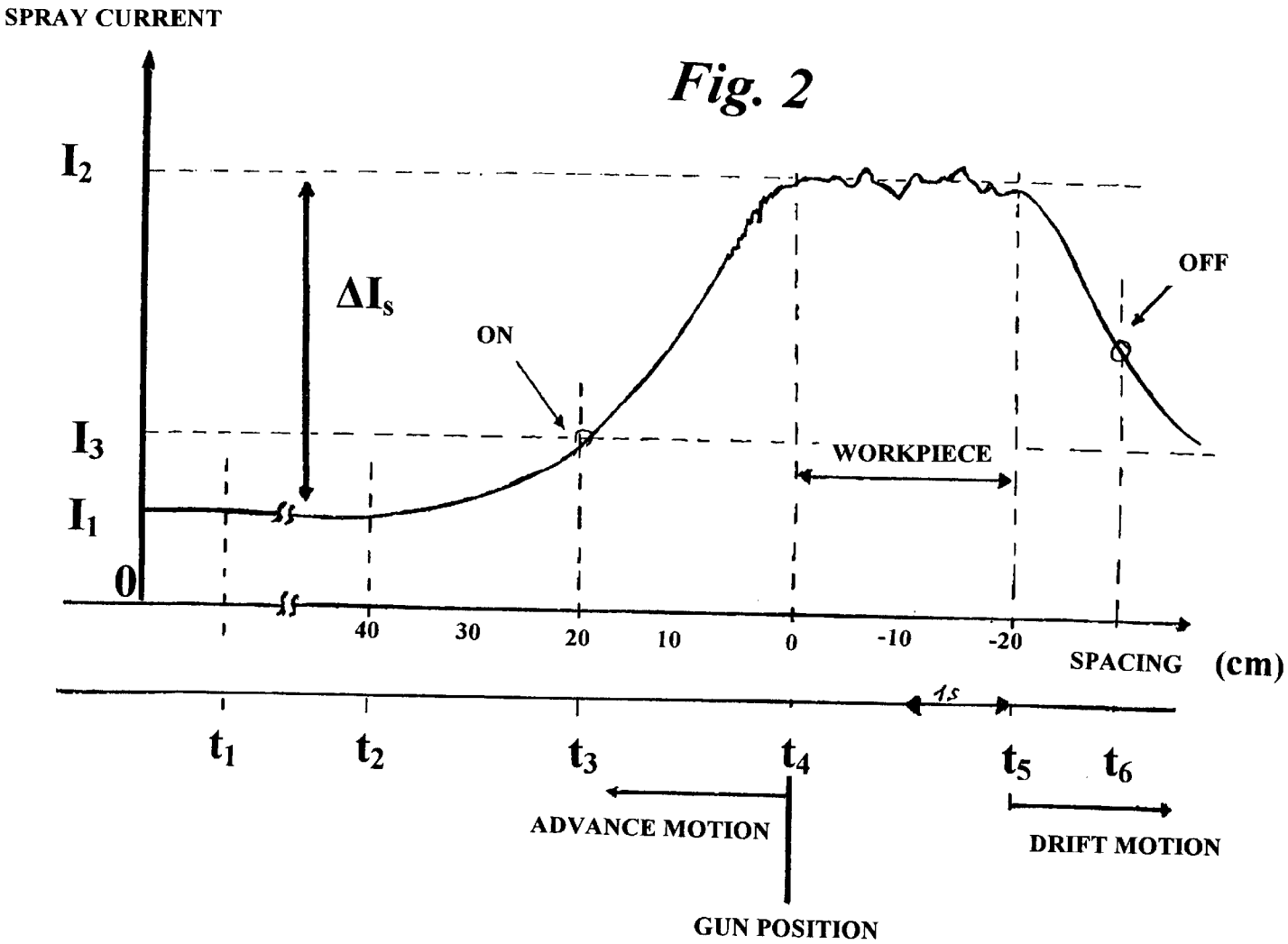
FIG. 2 shows a diagram of the spray current depending on the distance between a spray electrode and a workpiece.

FIG. 2 shows the relation between the electric spray current and the spacing between the coating device 66 and the workpiece 200 and the time, respectively. The y-axis shows the current, on the x-axis, the spacing is represented in cm and the time in seconds, wherein a constant supply speed of 10 cm/s is assumed.

At the time t1, the workpiece is still very far away from the spray gun 66. A spray current I1 flows to the closest ground, this spray current is measured continuously and compared to the preceding measured values. Until time t2 the current changes insignificantly. From time t2 onwards, the current starts rising. The approximate final value I2 can already be known from the previously coated workpiece. At the time t3 the workpiece is still approximately 20 cm away from the spray gun. The freely selectable switch-on threshold value is fixed in this example to 25% of $\Delta I_S$.

At the time t3 the switch-on condition is detected and the control device 60 sends a switch-on command to the injector via the gun bus 62. The injector 64 comprises two air quantity controllers for adjusting feed air and dosing air for the coating device. Thus, the powder supply is switched on. When the workpiece 200 reaches the coating gun 66 it will be coated. In the time interval t4 to t5 the workpiece passes the gun. In the described case, the length of the workpiece is 20 cm. From time t5 onwards, the workpiece 200 departs from the spray gun 66 and the spray current decreases. At the time t6 the workpiece is 10 cm away from the spray gun. A preselected switching threshold value (in this case 50% of $\Delta I_S$) is passed and the powder supply is switched off via the LON bus 92.

The spray current measured can also be used for adjusting the spacing between the workpiece 200 and the spray gun 66.

Figure 3:
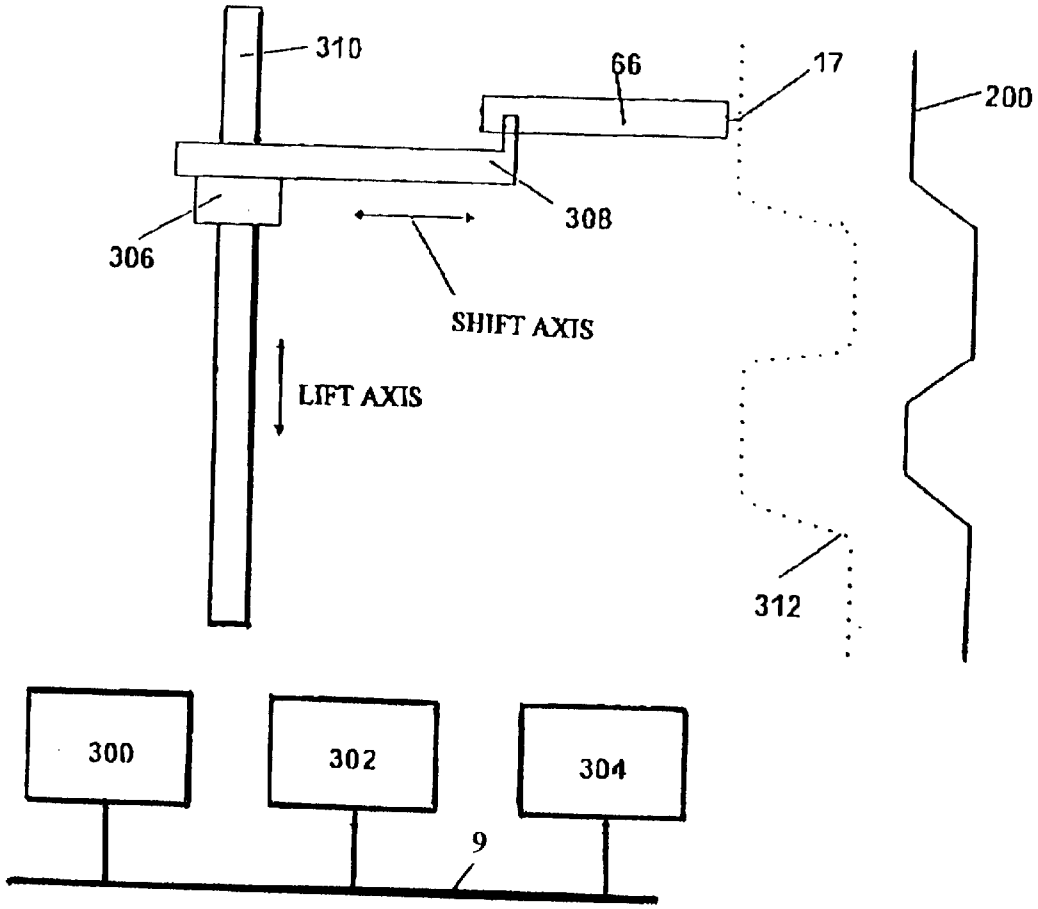
FIG. 3 is a schematic view for explaining the adjustment of the distance between the workpiece and the spray gun according to the invention.

FIG. 3 shows a possible configuration of the position control module. The position control is frequently designated as Z-axis control. Controls of that kind are known, coating devices, however, up to now move in a fixedly programmed path. In the new method the adaptation to the workpiece contour is made automatically.

The high voltage generator integrated into the spray gun 66 generates a spray current from the electrode 17 to the workpiece 200. This spray current is measured by a high voltage module 300 and passed on to a spacing controller 302. This controller tries to keep to a predetermined spray current. If for instance the spray current is smaller than predetermined, the controller 302 supplies a correction signal to a shift axis control 304. This control in turn causes a servo motor 306 and a gun support 308 and together therewith the gun 66 to move closer to the workpiece 200.

This control process has to be relatively fast. By moving the entire unit up and down by means of a lift device 310, the electrode 17 is moved along the broken line 312 thus keeping the gun permanently at a correct distance to the workpiece 200. The controller 302 in practical application is realized as a "software part" of the high voltage module 300. The above-mentioned controller is preferably not a standard PI or PID controller but a so-called intelligent controller.

The supply speed of the workpiece can be determined from the times at which the spray currents of a first and second spray gun 66-1 and 66-2 pass a predetermined threshold value, and depending on the detected times and the known distance between the first and the second spray gun, the speed of the workpiece is calculated.

Figure 4:
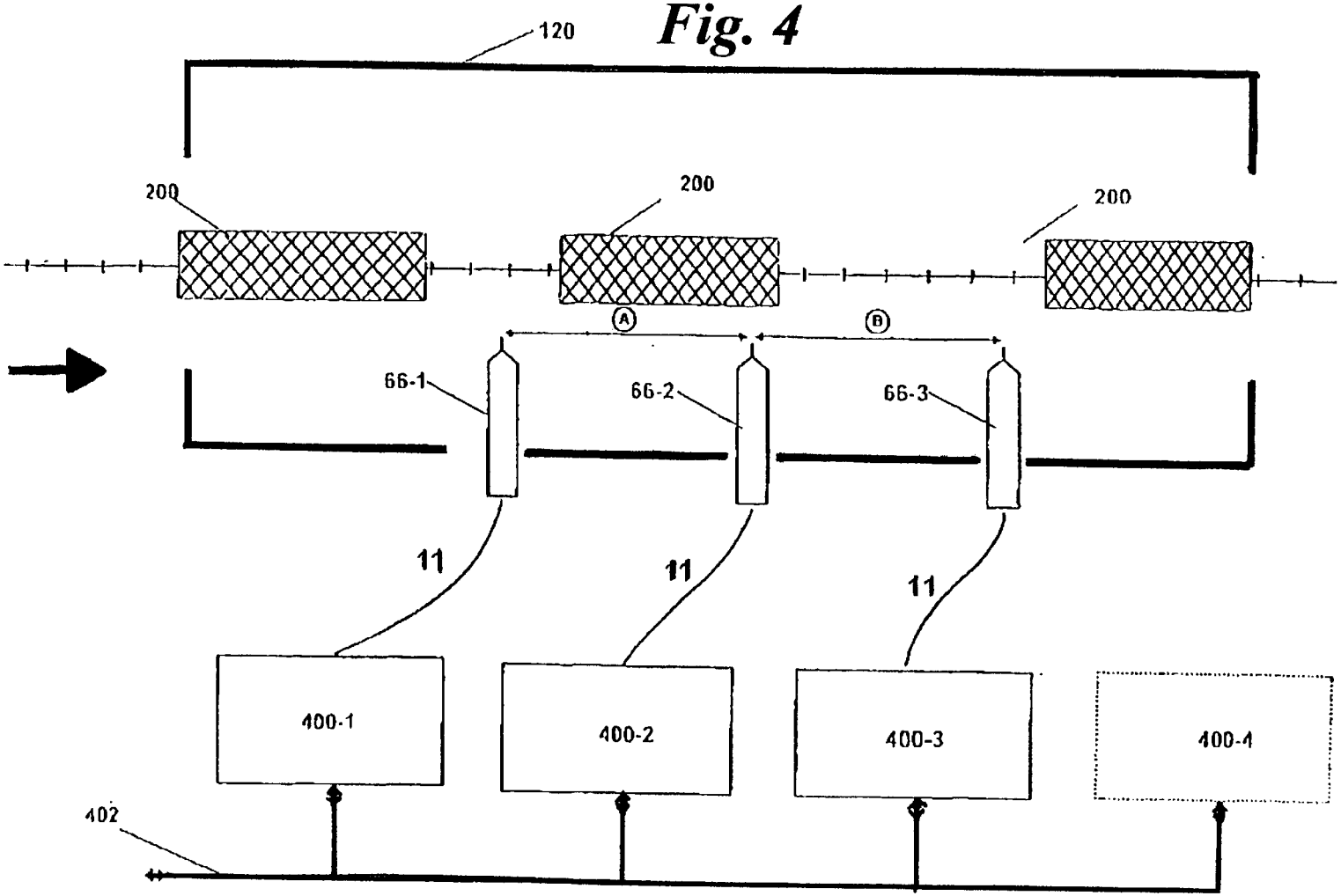
FIG. 4 is a schematic view for explaining the method of detecting the speed of a workpiece according to the invention.

FIG. 4 shows the basic arrangement of three guns.

The transport system feeds different workpieces 200 in the direction into the coating compartment 120. A workpiece 200 now moves towards the first coating gun 66-1. A first high voltage module 400-1 notes a rise of the spray current. A real time clock integrated into the module notes the exact moment of detection and transmits the start time of the measurement to a second high voltage module 400-2. The workpiece now moves to the second coating gun 66-2 and in turn triggers a start time by the aid of a real time clock.

This start value of the second measurement is then transmitted to the third high voltage module via the bus system 402. The start time of the second measurement is at the same time the stop time of the first measurement. By the aid of the known spacing A between the first and the second gun and the time difference between start and stop time, the speed of the workpiece is calculated and is transmitted via the bus 402 to any other bus participant 404, which for its operation has to know the speed of the transport system.

If the workpiece 200 further moves to the third gun 66-3, the second stop time is triggered. The second speed measurement value is detected from the second time difference (start time No. 2 and stop time No.2 ) and the known spacing B supplied to the bus 402.

A third speed measurement value can also be calculated from the first start time and the second stop time and from the path A+B, for controlling and/or for rounding. This third measurement value will be the most precise one, since inaccuracies in the time measurement and in the workpiece detection will have less effect the longer the measuring path and the measuring time are. Since the speed is newly determined for each workpiece, the average speed of the transport system can be calculated from a plurality of measurements.

The information about the workpiece speed can be used for controlling and synchronizing the vertical movement of the spray guns.

Figure 5A:
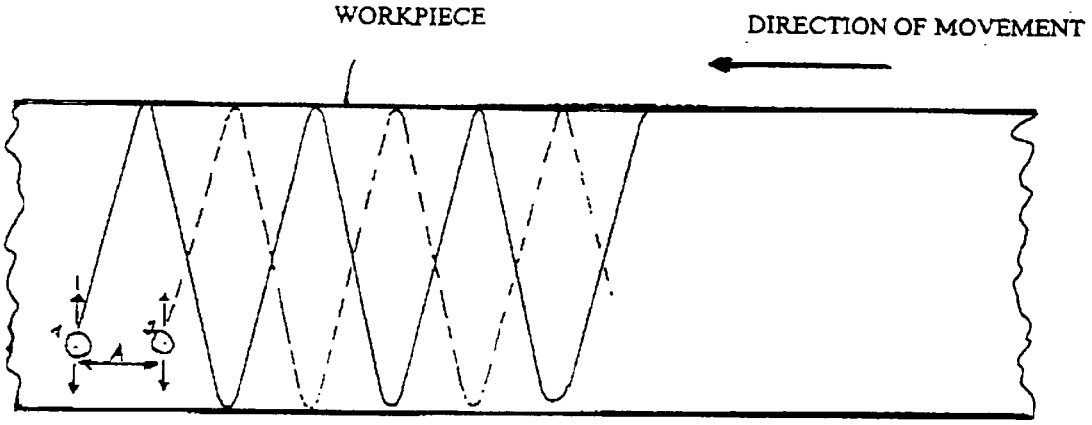
FIGS. 5*a*, 5*b* are two diagrams of different wave lines of coating material which are obtained by two synchronized and two non-synchronized coating devices, respectively.
Figure 5B:
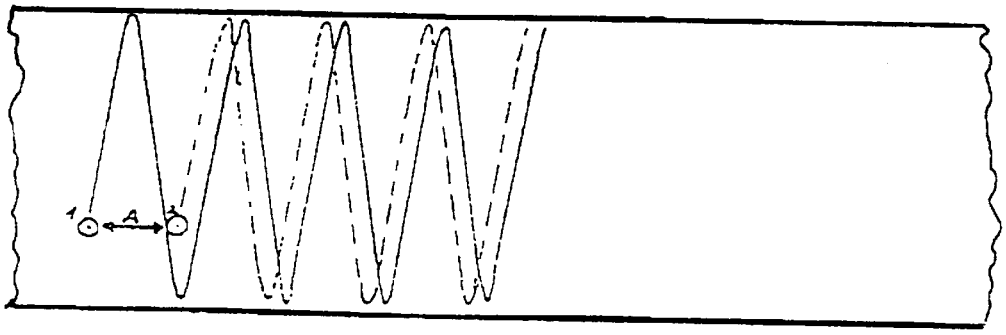

For the simplest case it is assumed that two coating guns are arranged horizontally side by side. These two coating guns are arranged at a spacing A (FIGS. 5*a* and 5*b*).

These two coating guns are attached on a so-called lift device (FIG. 3). The lift device moves the guns vertically up and down at a constant speed from bottom to top and at the same speed from top to bottom In the reversing points the direction of movement is switched as quickly as possible. In case of a rectangular workpiece which is transported continuously into the coating compartment, the entire surface is thereby coated evenly in case that the speeds of the transport means and of the lift device are "synchronized". For a better understanding, different cases are shown in FIGS. 5*a* and 5*b*.

The material deposition on the workpiece is similar to a Gaussian distribution regarding the layer thickness. Thus, the coating border in the width direction cannot be defined precisely. However, in the synchronized case (FIG. 5*a*) it can be recognized that the spray gun (2) coats that area of the workpiece that could not be coated by spray gun (1). By smudging the spray zones, the material distribution becomes optimal in the case of FIG. 5*a*. This is not the case in the non-synchronized case of FIG. 5*b*. In this Figure the second gun (2) predominantly coats the same area as previously coated by gun (1). Moreover, there are intermediate zones that are not coated.

If more than two guns are arranged side by side, a plurality of constellations exist in which an optimal coverage is achieved.

Each coating module can therefore detect the fact that a workpiece 200 approaches, as well as the kind, in particular the size and shape of the workpiece 200, the speed of the workpiece and the spacing of the workpiece to the spray gun. This information is supplied to the bus 100, 80 and is immediately available at the other components of the powder coating system.

For a better understanding of the spray current measurement, the following should be considered.

Generally, the generation of a high voltage in an electrostatic coating device is known. It is described in German patent application DE-A-42 32 026 how a circuit is designed which produces exactly reproducible current/voltage characteristic lines. These exactly reproducible characteristic curves are a basis for the method according to the invention.

Figure 6:
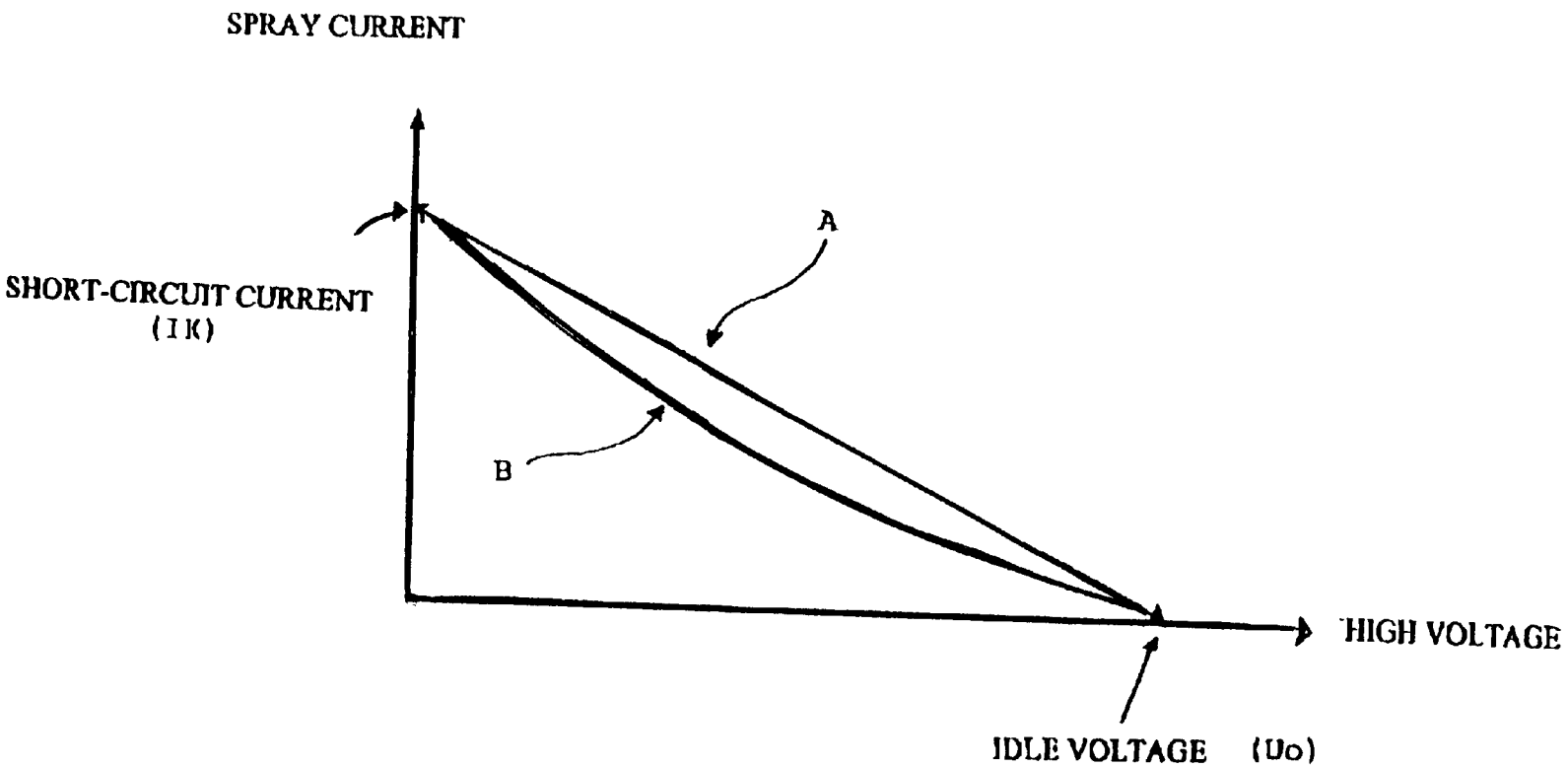
FIG. 6 shows an ideal and a real U/I characteristic curve of a high voltage electrode of a coating device.

A high voltage generation unit usually consists of a high voltage control module having an oscillator, a power amplifier and a control unit and of a high voltage generator in the gun, consisting of a high voltage transformer, a multiplier cascade and protective resistors. It has a U/I characteristic curve which determines the electrical behavior of the entire unit. If the total internal resistance was an Ohmic resistance, the U/I characteristic curve would be a straight line, having the end points: short-circuit current and idle voltage. See in this respect curve A in FIG. 6. In practice the inner resistance is divided into a plurality of complex internal resistances and Ohmic portions to be added. The characteristic curve resulting therefrom is shown in FIG. 6 as curve B. The actual load resistance of a coating unit is the air between the spray electrode and the workpiece and is of purely Ohmic nature. However, this Ohmic resistance depends on the shape of the workpiece, on the size, surface condition thereof, on the shape of the spray electrode, the air composition, temperature, pressure, humidity content and on the spacing between the electrode and the workpiece and also on the high voltage generator.

The form of the real U/I characteristic curve B is the same in any combination of control unit and high voltage generator when using a suitable control.

Figure 7:
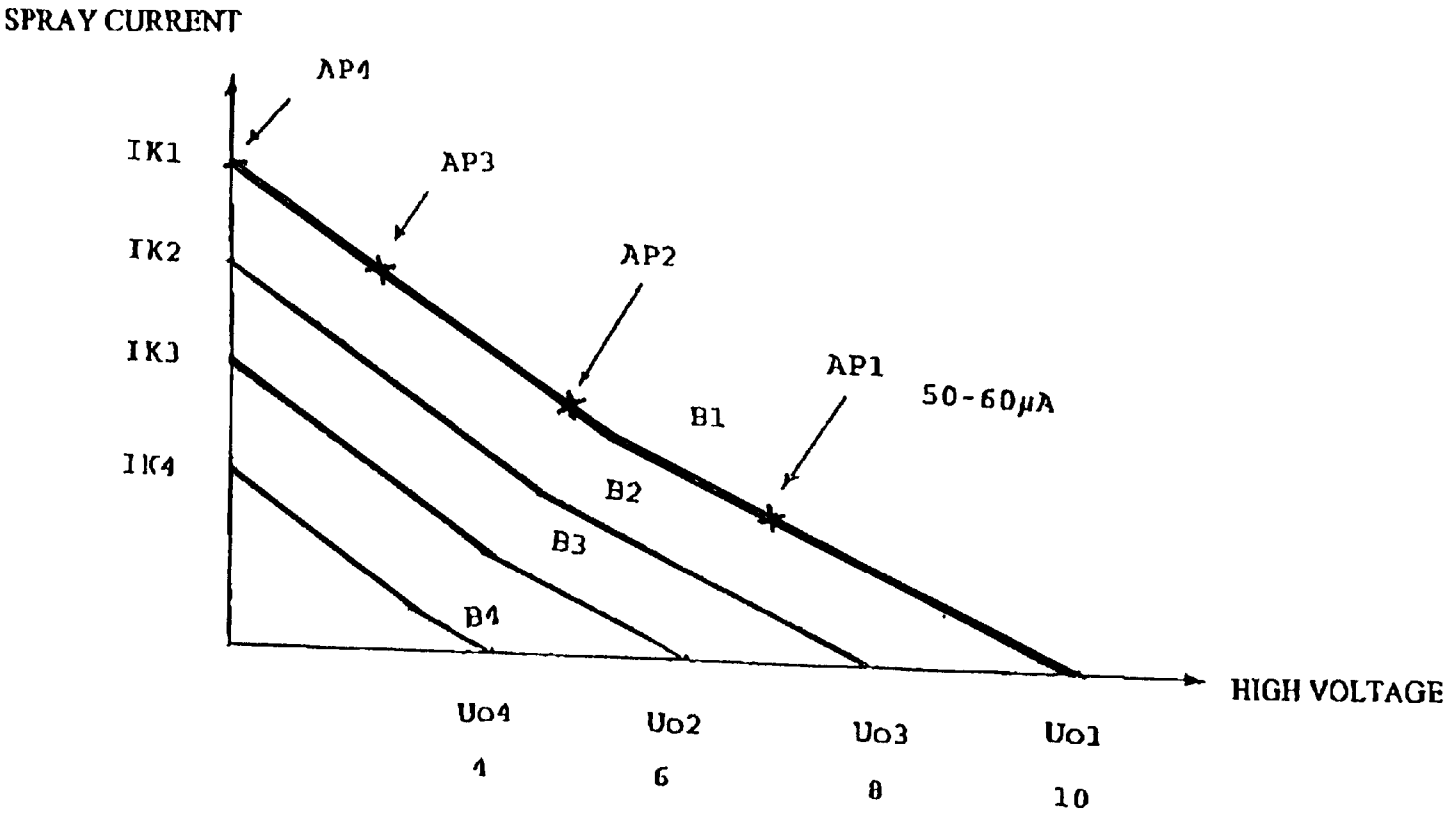
FIG. 7 is a group of curves of U/I characteristic lines for different supply voltages of the high voltage generator of a coating device.

FIG. 7 shows a group of curves formed of a plurality of different voltage settings or, to be more precise different power amplifier supply voltage settings. In FIG. 7 the values $U_{OX}$ correspond to the idle voltages, which are proportional to the supply voltages selected. (For the sake of simplicity, the curved characteristic line is shown by a bend.)

If for instance, taking a look at curve $B_1$ with its end points $U_{01}$ and $I_{k1}$, four possible working points are shown thereon. $AP_1$ corresponds to a very large spacing between the workpiece and the spray electrode, wherein the workpiece is permanently grounded. The spacing is so large that the charged particles moving through the air do not reach the workpiece but for instance the gun holder. The point AP1 therefore represents the maximum high voltage and the minimum current occuring in practice. (The point $U_{01}$ can be reached in the laboratory only under certain conditions.) If the spacing between the workpiece and the electrode is reduced, the working point moves along curve $B_1$ towards $AP_2$. At this point, a considerable portion of the charge is already discharged via the workpiece. If the spacing between workpiece and electrode is further reduced until contact, the working point further moves over $AP_3$ to $AP_4$ (short circuit).

If one intends to carry out a voltage measurement, a voltage divider had to be installed in the high voltage generator, which delivers a small voltage proportional to the high voltage. This voltage divider has to be dimensioned for high voltages up to 100 kV and is therefore large and voluminous.

In contrast thereto, the measurement of the spray current is more favorable and will be described below.

The form of the U/I characteristic curve is stored in the high voltage module. Moreover, the high voltage module knows the relation between the supply voltage and $U_O$. Thus, the high voltage module knows the entire group of actual curves of FIG. 7 including all intermediate curves that are not shown.

The high voltage module calculates the current idle voltage $U_{0a}$ from the linear relation between the supply voltage of the high voltage generator (which is measured) and $U_O$. The associated U/I characteristic curve dates are retrieved from the memory. The spray current $I_{sm}$ measured is used by the computer for determining the current working point $AP_a$. Thereby the current electrode voltage $U_a$ is also determined.

For the above described workpiece detection, it is sufficient to know the characteristic curve to be used and the spray current measured. Frequently it is desirable to display the current electrode voltage $U_a$ besides the spray current.

Figure 8:
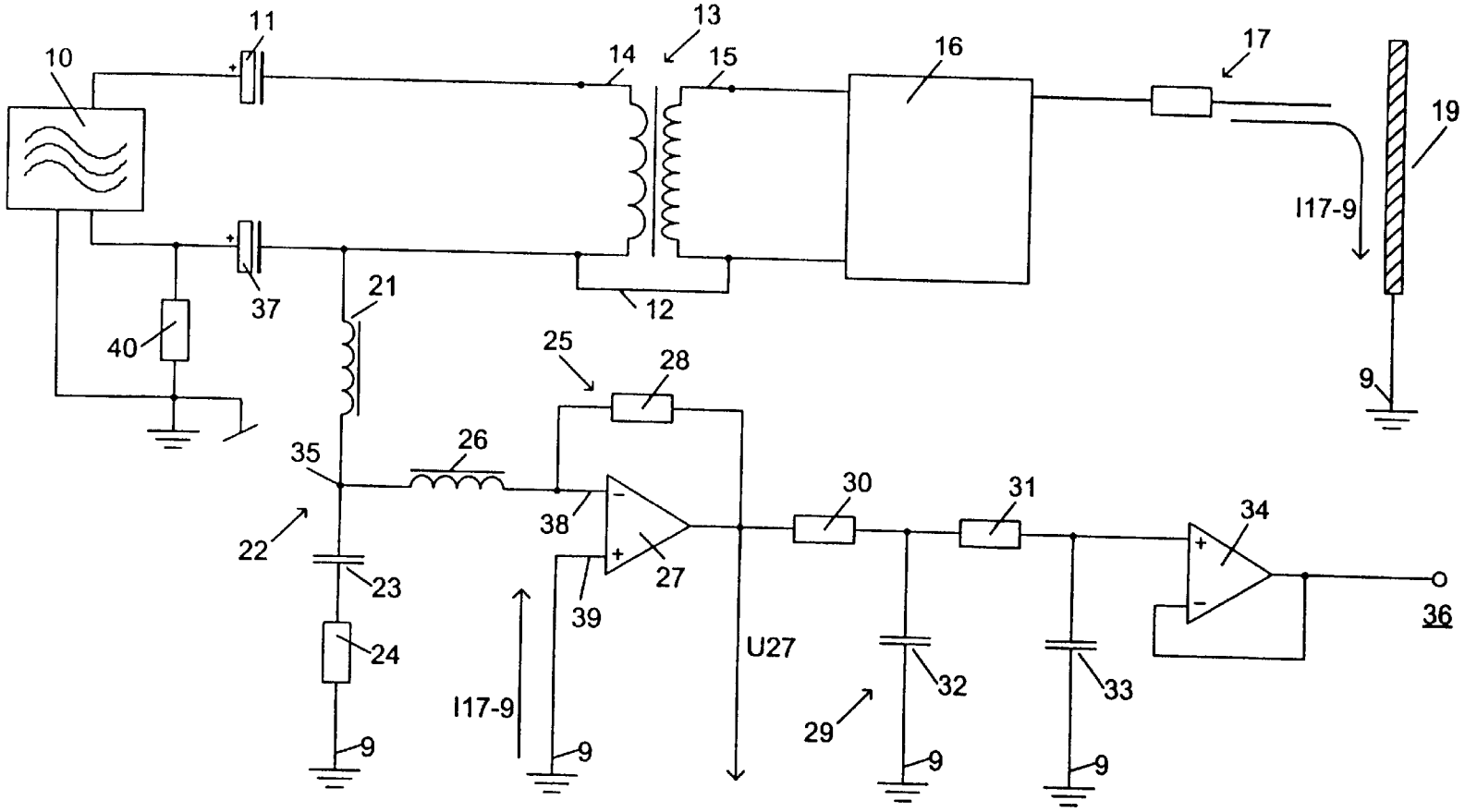
FIG. 8 is a means for detecting the electric spray current.
Figure 9:
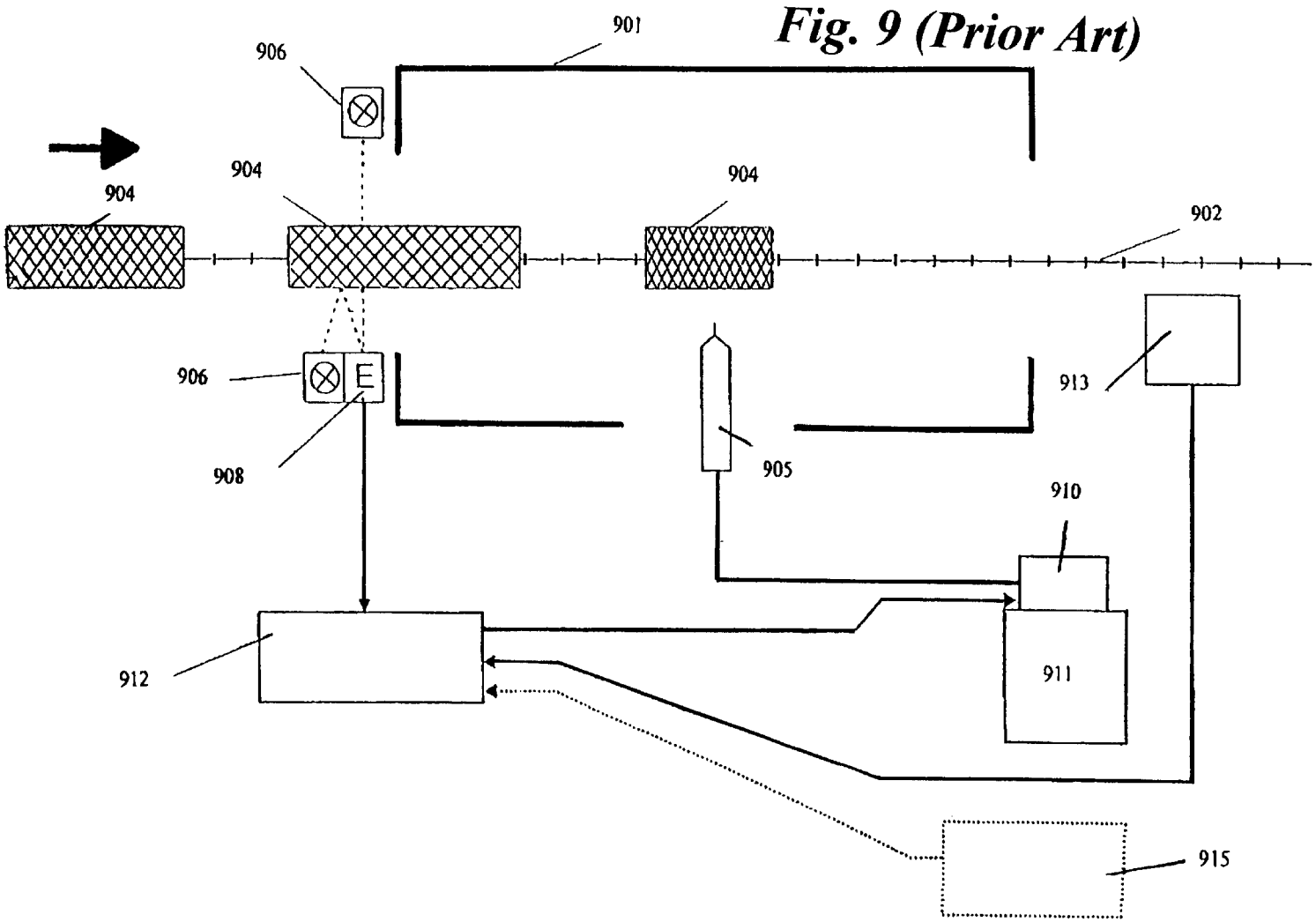
Fig. 9 (Prior Art)
FIG. 9 is a coating system according to the prior art having a gap control.

FIG. 8 shows a current measuring circuit. The circuit of the figure comprises a control means 19, two coupling capacitors 11, 37, a transformer 13 having a primary coil 14 and a secondary coil 15, which are connected to one another via a bridge 12, a high voltage cascade 16, an electrode 17 having an electrode resistance and a resistor 18, which are connected to one another in the manner shown in FIG. 8. Furthermore, a low pass filter designated by 22 as well as a current/voltage converter designated by 25 exist. FIG. 8 also shows a workpiece 19 to be coated.

The low pass filter 22 comprises a first low pass coil 21, which is connected on the side of the bridge 12 to the primary coil 14 and, via a capacitor 23, to the ground 9, and a second low pass coil 26, which connects the current/voltage converter 25 to the connection point 35 of the first low pass coil 21 and the capacitor 23. Additionally, a resistor 24 is connected in series to the capacitor 23.

The current/voltage converter 25 comprises an operational amplifier 27, the output of which being connected via a feed back resistor 28 to its inverting input. The second low pass coil 26 is also connected to the inverting input 38 of the operational amplifier 27, and the non-inverting input 39 of the operational amplifier 27 is connected to the ground 9.

At the output of the current/voltage converter 25, a filter network 29 is arranged consisting of two resistors 30 and 31 and two capacitors 32 and 33 as well as an output amplifier which are connected to one another in the manner shown in FIG. 2.

The circuit of FIG. 2 operates as follows. If a workpiece 19 is in front of the electrode 17 and electric charge is transferred to the workpiece 19, a spray current flows through air particles (ions) and powder particles to the workpiece and through the ground back to the control device. This spray current flows through the operational amplifier 27, the low pass filter 22 and via the transformer bridge 12 back into the high voltage cascade 16. The current/voltage converter 25 is structured and dimensioned such that a voltage is generated at the output of the operational amplifier 27 which is proportional to the electric spray current from the electrode 19 to the ground 9.

The voltage at the output 36 of the measuring circuit can be evaluated in the above-mentioned manner.

The features disclosed above in the description, in the claims and in the drawing can be meaningful for realizing the invention in the different embodiments either individually or in any combination with one another.

We claim:

1. A method of detecting and coating workpieces in an electrostatic coating system, comprising the steps of:

applying a high voltage to a high voltage electrode (17) of at least one electrostatic coating device (66), in which a spray current containing electrical charges for charging particles of a coating material to be sprayed is generated by the high voltage electrode;

passing an electrically conductive workpiece (19; 200) to be coated by the at least one coating device;

determining the spray current of the high voltage electrode (17);

detecting whether the workpiece is in front of the at least one coating device (66) depending on the magnitude of the determined spray current;

starting a discharge of the coating material by the at least one coating device when the spray current exceeds a first threshold value of spray current; and stopping the discharge of coating material by the at least one coating device when the spray current falls below a second threshold value of spray current.

2. A method according to claim 1, further comprising the additional step of controlling at least one of a discharge of the coating material and a movement of the at least one coating device (66) in at least one of a vertical and a horizontal direction.

3. A method according to claim 1, characterized in that the spray current is compared to the first threshold value of spray current and as soon as the spray current exceeds the first threshold value, it is detected that the workpiece (19;200) approaches the coating device (66).

4. A method according to claim 1 characterized in that the distance in a spray direction between the workpiece (19; 200) and the high voltage electrode (66) is detected and adjusted depending on the spray current.

5. A method according to claim 4, characterized in that the spray current is compared to a target value and as soon as the spray value exceeds or falls below a target value by a predetermined value, the distance between the high voltage electrode (17) and the workpiece (19; 200) is corrected.

6. A method according to claim 1, characterized in that at least two coating devices (66) are provided, and further characterized by the additional steps of detecting a first time (t1) and a second time (t2) at which the spray currents of a first and a second coating device exceed a predetermined threshold value of spray current;

calculating a time difference (t2–t1) therefrom; and determining the speed of the workpiece (19; 200) based on the time difference and the spacing between the first and the second coating devices (66).

7. A method according to claim 6, characterized in that a vertical movement of at least the first and the second coating devices (66) is controlled depending on the speed of the workpiece (19; 200).

8. A method according to claim 3, characterized in that at least two coating devices (66) are provided, and further characterized by the additional steps of detecting a first time (t1) and a second time (t2) at which the spray currents of a first and a second coating device exceed a predetermined threshold value of spray current;

calculating a time difference (t2–t1) therefrom; and determining the speed of the workpiece (19; 200) based on the time difference and the spacing between the first and the second coating devices (66).

9. A method according to claim 1, characterized in that a plurality of U/I characteristic curves for the at least one coating device (66) are stored, that an associated U/I characteristic curve is selected to correspond to the supply voltage of a high voltage generator (12–16) for the high voltage electrode (17), that the spray current (I 17-9) is measured and that a working point on the U/I characteristic curve is determined in accordance with the spray current and the actual high voltage at the electrode is determined thereby.

10. The method of claim 1 further comprising measuring the spray current using a measuring device (22, 25); and using a control device (60) to detect whether the workpiece (19; 200) is in front of at least one coating devices (66) in response to the measured spray current.

11. The method of claim 10 further comprising using a bus structure (62) between the control device (60) and the at least one coating device (66) to control the operation of the at least one coating device in accordance with the measured spray current.

12. The method of claim 11 wherein the at least one coating device comprises a plurality of coating devices (66) exist and further wherein the method is characterized by the additional steps of:

connecting each of the coating devices to a respective control device (60) via the bus structure (62) to form a plurality of network nodes; and connecting the control devices (60) together via a coating bus (80).

13. The method of claim 12, characterized in that the network nodes are LON nodes.

14. The method of claim 1 wherein the step of applying a high voltage to the high voltage electrode further includes using a high voltage generator (13, 16) having a transformer (13) with a primary coil (14) and a secondary coil (15) connected together by a bridge (12) and wherein the primary coil is is driven by an alternating voltage.

15. The method of claim 14 wherein the step of determining the spray current further comprises:

connecting a low pass filter (22) between the primary coil and a ground (9), and connecting a current/voltage converter (25) to the low pass filter.

16. The method of claim 1 further including the additional steps of:

storing a plurality of U/I characteristic curves for different supply voltages of the high voltage electrode (17), selecting a U/I characteristic curve depending upon the supply voltage, determining a working point on the U/I characteristic curve selected depending on the spray current, and using the working point to determine the actual high voltage at the electrode.

17. The method of claim 15 wherein the current/voltage converter comprises a current-controlled voltage source (27, 28) and wherein the method further includes using a first coil (21) having a first end and a second end, a second coil (26) having a first end and a second end, a capacitor (23) having a first end and a second end, and a resistor (24) having a first end and a second end, wherein the step of determining the spray current using the low pass filter further includes:

connecting the first end of the first coil (21) to the primary coil (14), connecting the second end of the first coil (21) in series via a connection point (35) to the first end of the capacitor (23), connecting the second end of the capacitor (23) in series with the first end of the resistor (24), connecting the second end of the resistor (24) to the ground (9), and connecting the connection point (35) to an input of the current/voltage converter (25).

* * * * *